US006219970B1

(12) United States Patent
Liu

(10) Patent No.: US 6,219,970 B1
(45) Date of Patent: Apr. 24, 2001

(54) WINDOW SHUTTER HAVING RECESSED SIDE ACTUATING LOUVER MEMBER

(76) Inventor: Armin Liu, 2411 San Diego Ct., Claremont, CA (US) 91711

( * ) Notice: Subject to any disclaimer, the term of this patent is extended or adjusted under 35 U.S.C. 154(b) by 0 days.

(21) Appl. No.: 09/412,730

(22) Filed: Oct. 5, 1999

(51) Int. Cl.[7] ..... E06B 7/086
(52) U.S. Cl. ..... 49/77.1; 49/74.1; 49/64
(58) Field of Search ..... 49/74.1, 77.1, 49/80.1, 86.1, 61, 63, 64

(56) References Cited

U.S. PATENT DOCUMENTS

| | | | |
|---|---|---|---|
| 163,679 | 5/1875 | Merrill . | |
| 192,353 | 6/1877 | Smits . | |
| 312,053 | 2/1885 | Willer . | |
| 465,395 | 12/1891 | Stoeppelwerth et al. . | |
| 863,573 | 8/1907 | McCord . | |
| 2,139,611 | 12/1938 | Welch . | |
| 3,110,936 | 11/1963 | Berard . | |
| 3,691,687 | 9/1972 | Economou . | |
| 5,595,536 | 1/1997 | Cornell . | |
| 5,755,270 | 5/1998 | Knezevich et al. . | |
| 5,778,598 * | 7/1998 | Ohaneshian | 49/74.1 |
| 5,887,386 | 3/1999 | Alexanian et al. . | |

FOREIGN PATENT DOCUMENTS

| | | | |
|---|---|---|---|
| 1683173 * | 11/1969 | (DE) | 49/74.1 |

* cited by examiner

*Primary Examiner*—Jerry Redman
(74) *Attorney, Agent, or Firm*—Chan Law Group LC; Brett L. Halperin

(57) ABSTRACT

A frame member having a centrally disposed opening, a plurality of louvers pivotally disposed within the opening of the frame member, a relief notch on the lateral edge of the louver, and a louver adjusting member attached to the plurality of louvers. The louver adjusting member is completely disposed within the relief notch of the louvers, thereby maintaining at least a flush profile on either the inner surface or outer surface of the window shutter when the louvers are in the closed position. The window shutter apparatus further comprises a hanging strip that includes pivotally attaching the frame member thereto, a compliance strip for attachment to the hanging strip, and a T-strip attached to either the hanging strip or frame member. The compliance strip adjusts for dimensional variations in the side surfaces of the window opening that leave a gap when the hanging strip is placed adjacent thereto. The T-strip is attached to either the hanging strip or the frame member to conceal a gap formed between the frame member and the hanging strip when the window shutter is in the closed position. The T-strip is also attached to the frame member to conceal a gap formed between a pair of frame member placed adjacent one another when the window shutter is in the closed position.

21 Claims, 4 Drawing Sheets

WINDOW SHUTTER HAVING RECESSED SIDE ACTUATING LOUVER MEMBER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to window coverings, and more particularly to a window shutter assembly having a recessed side actuating louver 2. Description of the Background Art Window shutters are used to shield a room or area from the elements, as well as to provide privacy and security to persons therein. In addition, window shutters preferably also add to the aesthetic appeal to the decor of both the room when viewed internally, and the structure or building when viewed externally.

Window shutters having adjustable louvers serve the foregoing purposes while allowing for air to circulate or pass through the window when the window shutter is closed. The louvers, which are typically disposed horizontally and parallel to each other, are movable angularly between a closed position wherein it serves as a barrier to the elements, to an open position wherein air may flow therethrough. Positioning the louvers at any point between the fully closed position and the fully open position not only allows for restricting or controlling air flow therethrough, but also directing the air flow.

In order to adjust a plurality of louvers simultaneously, an adjustment arm or member is attached to the louvers, which essentially chains them together so that moving any one of the louvers to any position causes a corresponding movement of the remaining louvers that are correspondingly attached by the adjustment arm or member. This obviously facilitates louver adjustment. The problem that arose with the employment of the adjustment arm or member is that it was somewhat obtrusive and when disposed along the middle section of the louvers, it partially obstructed the view through the louvers when they are open. There are some designs that place the adjustment arm or member on the side edge of the louver so as to prevent obstruction of the view therethrough when the louvers are open, however, these adjustment arms or members, regardless of whether they are disposed in the center or side edge of the louvers, generally detract aesthetically from the overall appearance of the window shutter.

To solve the problems of obstruction and aesthetics caused by the adjustment arm or member, internal mechanisms were incorporated within the window shutter to allow for simultaneous adjustment of the louvers. These internal adjustment mechanisms proved to be complicated, requiring an excessive number of components and thus are very expensive to manufacture.

For a window shutter to open and closed within a window opening, a hanging strip is used in conjunction with each window shutter. The hanging strip includes hinges for the attachment of the window shutter thereto thereby allowing the window shutter to swing between a closed and an open position. The hanging strip basically serves as an interface between the window shutter and the side wall surfaces of the window opening.

Due to variations in tolerances, the side wall surfaces of the opening in most windows typically do not form a straight line, nor are they perfectly perpendicular to the bottom or top surfaces of the window openings. As such, crevices exist between the side wall surfaces and hanging strips when window shutters are installed in the window opening. These crevices allow for the passage of the weather elements therethrough, as well as reduce the privacy enjoyed by the occupants within the room or area enclosed thereby, thereby defeating the purpose of closing the window shutters in the first place. Inherent in the configuration and function of window shutters, gaps are also formed between the hanging strip and the window shutter, as well as between a pair of window shutters placed adjacent one another, when the window shutter is in the closed position.

Accordingly, there is a need for an adjustable window shutter having a louver adjustment that is relatively inconspicuous, yet simple in design and inexpensive to manufacture. There is also a need for a window shutter that effective conceals gaps formed between the window opening and the hanging strip, between the hanging strip and the window shutter, and also between two window shutters, when the window shutters are closed. The present invention satisfies these needs, as well as others, and generally overcomes the deficiencies found in the background art.

BRIEF SUMMARY OF THE INVENTION

The present invention pertains to an adjustable window shutter apparatus having a simple and reliable side mounted louver adjustment member that is relatively inconspicuous, while providing for a means to conceal gaps that form between closed window shutters and between window shutters and hanging strips, as well as a means to account for dimensional variations between the hanging strip and the side wall surface of the window opening.

By way of example and not of limitation, the adjustable window shutter apparatus of the present invention generally comprises a frame member having a centrally disposed opening, a plurality of louvers pivotally disposed within the opening of the frame member, a relief notch on the lateral edge of the louver, and a louver adjusting member attached to the plurality of louvers. The louver adjusting member is completely disposed within the relief notch of the louvers, thereby maintaining at least a flush profile on either the inner surface or outer surface of the window shutter when the louvers are in the closed position.

The window shutter apparatus further comprises a hanging strip that includes a means for pivotally attaching the frame member thereto, a compliance strip for attachment to the hanging strip, and a concealment strip attached to either the hanging strip or frame member. The compliance strip is fabricated from a generally compressible material which adjusts for dimensional variations in the side surfaces of the window opening that leave a gap when the hanging strip is placed adjacent thereto. The concealment strip, which preferably has a T-shaped cross section, is attached to either the hanging strip or the frame member to conceal a gap formed between the frame member and the hanging strip when the window shutter is in the closed position. The concealment strip may also be attached to the frame member to conceal a gap formed between a pair of frame members placed adjacent one another, when the window shutter is in the closed position.

An object of the invention is to provide an adjustable window shutter apparatus.

Another object of the invention is to provide an adjustable window shutter apparatus having a louver adjustment member that is relatively inconspicuous and that maintains a flush profile on either the inner surface or outer surface of the window shutter when the louvers are in the closed position.

Still another object of the invention is to provide an adjustable window shutter apparatus having a means for adjusting for dimensional variations existing in the side surfaces of window openings.

Still another object of the invention is to provide an adjustable window shutter apparatus having a means for concealing gaps that form between the frames of window shutters positioned adjacent one another when the window shutter is in a closed position.

Still another object of the invention is to provide an adjustable window shutter apparatus having a means for concealing gaps that form between the frame of the window shutter and a hanging strip when the window shutter is in a closed position.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
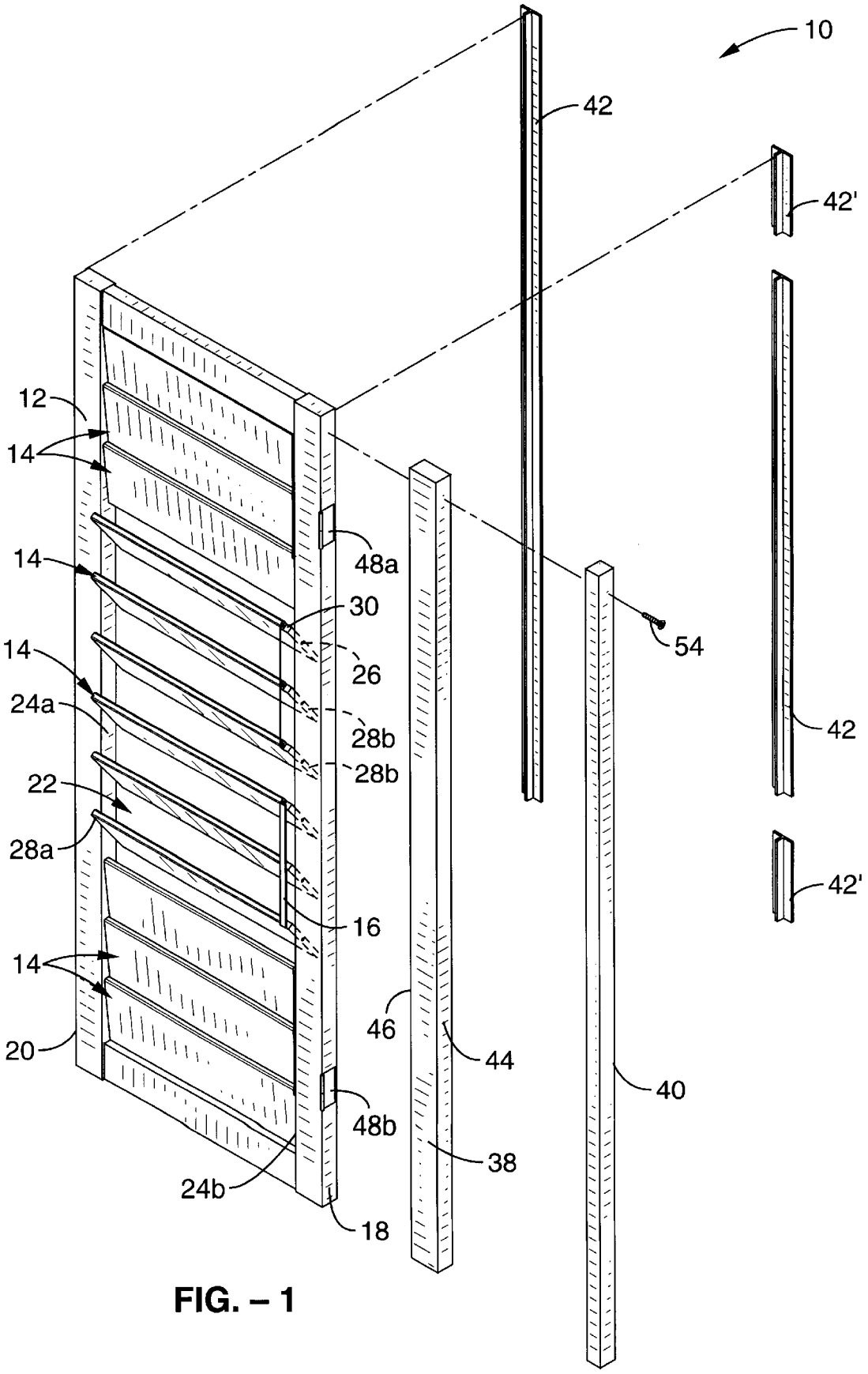
FIG. 1 is an exploded view, in perspective, of a window shutter apparatus in accordance with the present invention.
Figure 2:
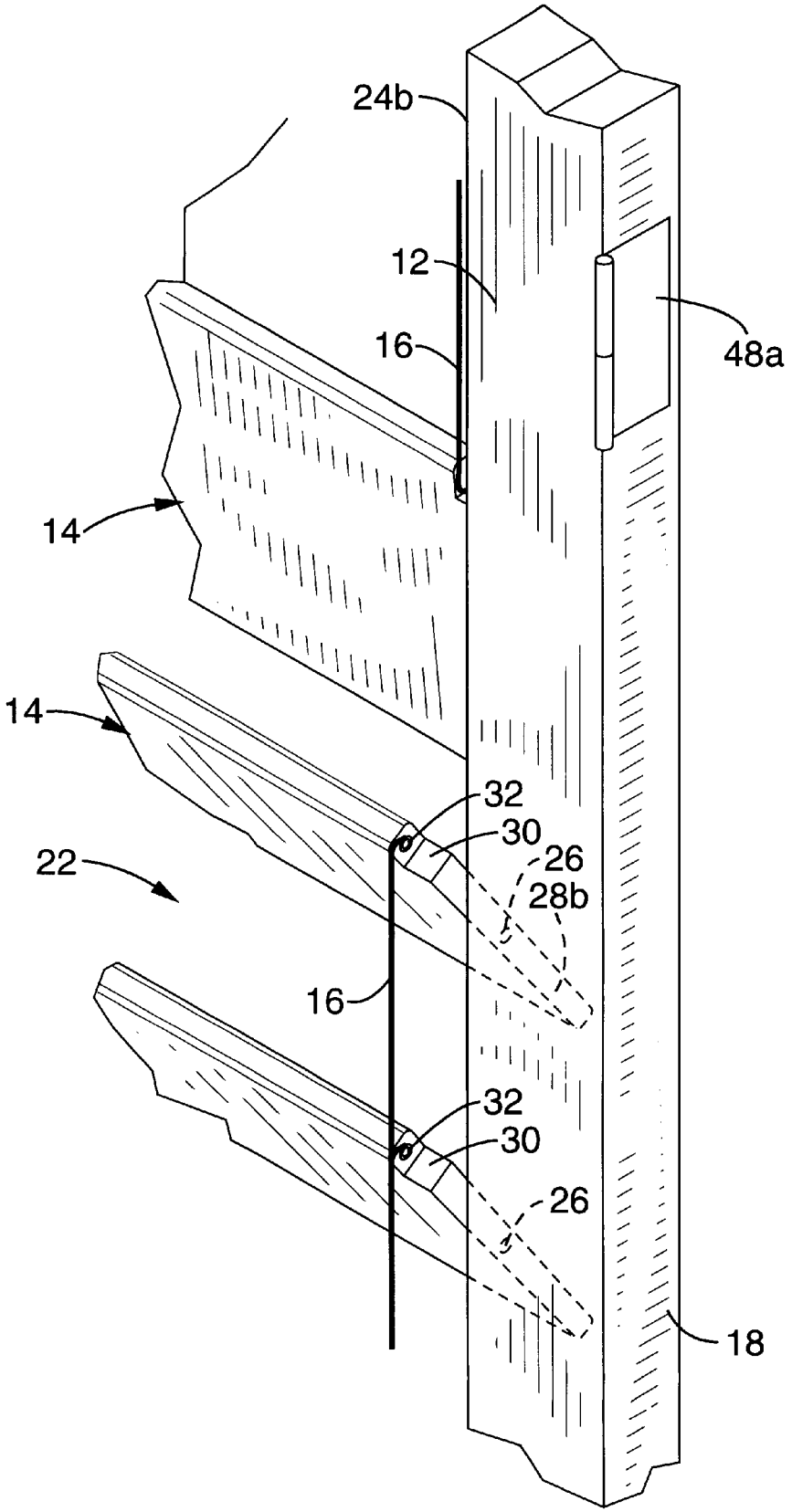
FIG. 2 is a sectional view, in perspective, of a shutter frame and louvers shown in FIG. 1.

Referring more specifically to the drawings, for illustrative purposes the present invention is embodied in the apparatus generally shown in FIG. 1 through FIG. 4. It will be appreciated that the apparatus may vary as to configuration and as to details of the parts without departing from the basic concepts as disclosed herein.

Referring first to FIG. 1 through FIG. 4, an adjustable window shutter apparatus 10 in accordance with the present invention is generally shown. Apparatus 10 generally comprises a frame member 12, a plurality of louvers 14, and at least one louver adjusting member 16.

Frame member 12 includes an inner side edge 18, an outer side edge 20, and an opening 22 disposed therebetween. Opening 22 is typically rectangular, as shown, and is bordered by includes a pair of side surfaces 24*a* and 24*b*. Side surfaces 24*a* and 24*b* incorporate a plurality of evenly spaced holes 26.

Louvers 14 include a pair of lateral edges 28*a* and 28*b* and a relief notch 30 on at least one of said lateral edges 28*a* and 28*b*. Lateral edges 28*a* and 28*b* each incorporate a pin (not shown) adapted to be pivotally disposed within holes 26 on side surfaces 24*a* and 24*b* of frame member 12. Louvers 14 are therein disposed in a generally parallel orientation and are pivotally adjustable between a closed position and an open position.

Figure 3:
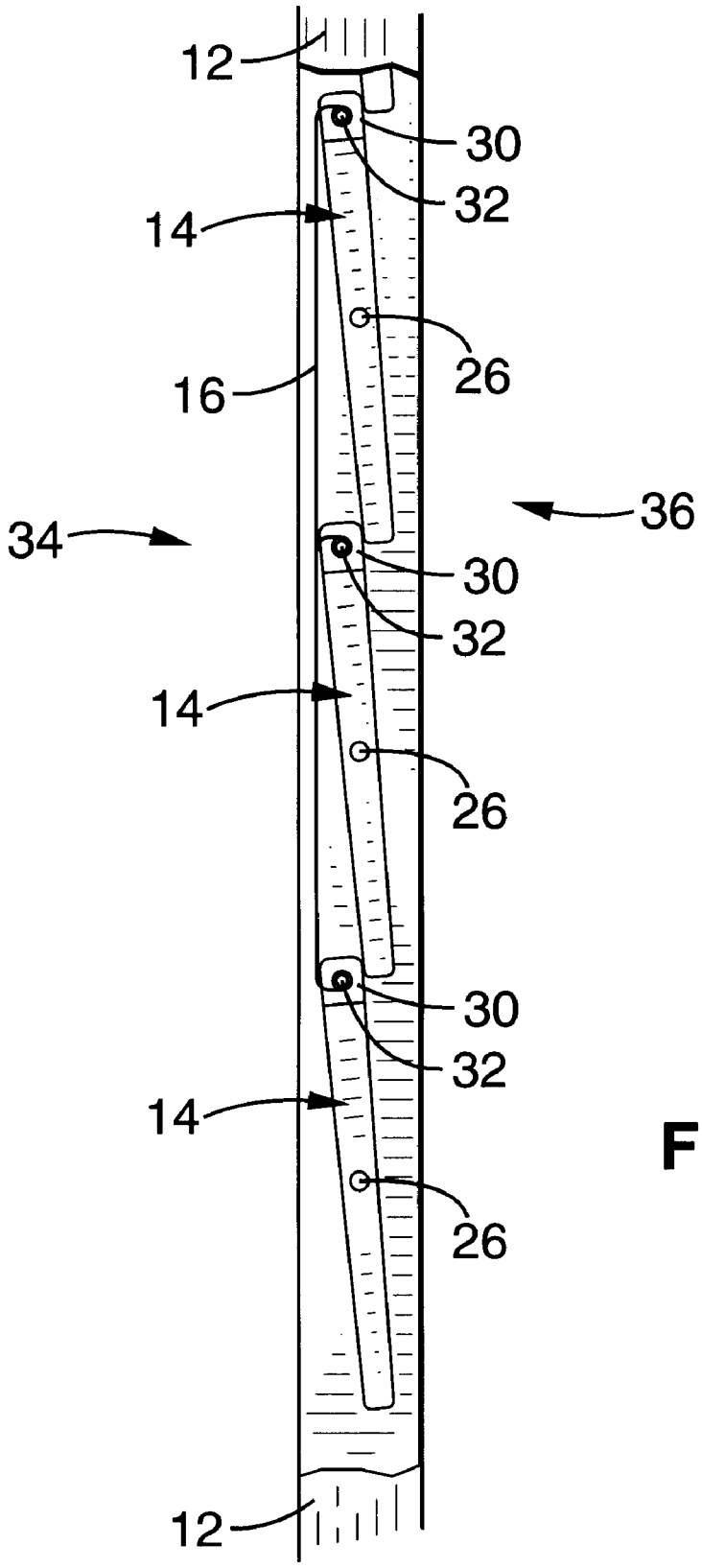
FIG. 3 is an elevational view of an inner side of the apparatus shown in FIG. 1.

Louver adjusting member 16 is preferably an elongated strip or wire that preferably has a small cross section. Louver adjusting member 16 is typically attached to each louver 14 by any means that allow for pivotal movement of louvers 14 relative to louver adjusting member 16. Such attachment means may include, but is not limited to, a nail 32 (as shown), a pin, a screw, a rivet, or the like. It can be seen that louver adjustment member 16 provides for adjustment of a plurality of louvers 14 so attached by moving any single louver 14. Louver adjusting member 16 is disposed within relief notch 30 of louver 14 such that louver adjusting member 16 resides between the inner plane 32 and the outer plane 34 of frame member 12 when louvers 14 are in the closed position, as shown in FIG. 3. This provides for a flush appearance for apparatus 10 relative to inner plane 32 and the outer plane 34 of frame member 12 when louvers 14 are in the closed position.

It is contemplated that a plurality of louver adjustment members 16 may also be used in apparatus 10. Each louver adjusting member is pivotally attached to a separate plurality of louvers 14 in consecutive fashion, thereby forming individual sections of louvers that are independently adjustable relative to another section of louvers. This independent adjustability of sections of louvers allows for a greater variance of the amount of light or air passing through apparatus 10. For example, two sections of louvers may be open while the remaining sections may be closed, as shown in FIG. 1. Additionally, one section of louvers may be positioned independently from the other sections, perhaps to direct air flow therethrough in a specific direction.

Figure 4:
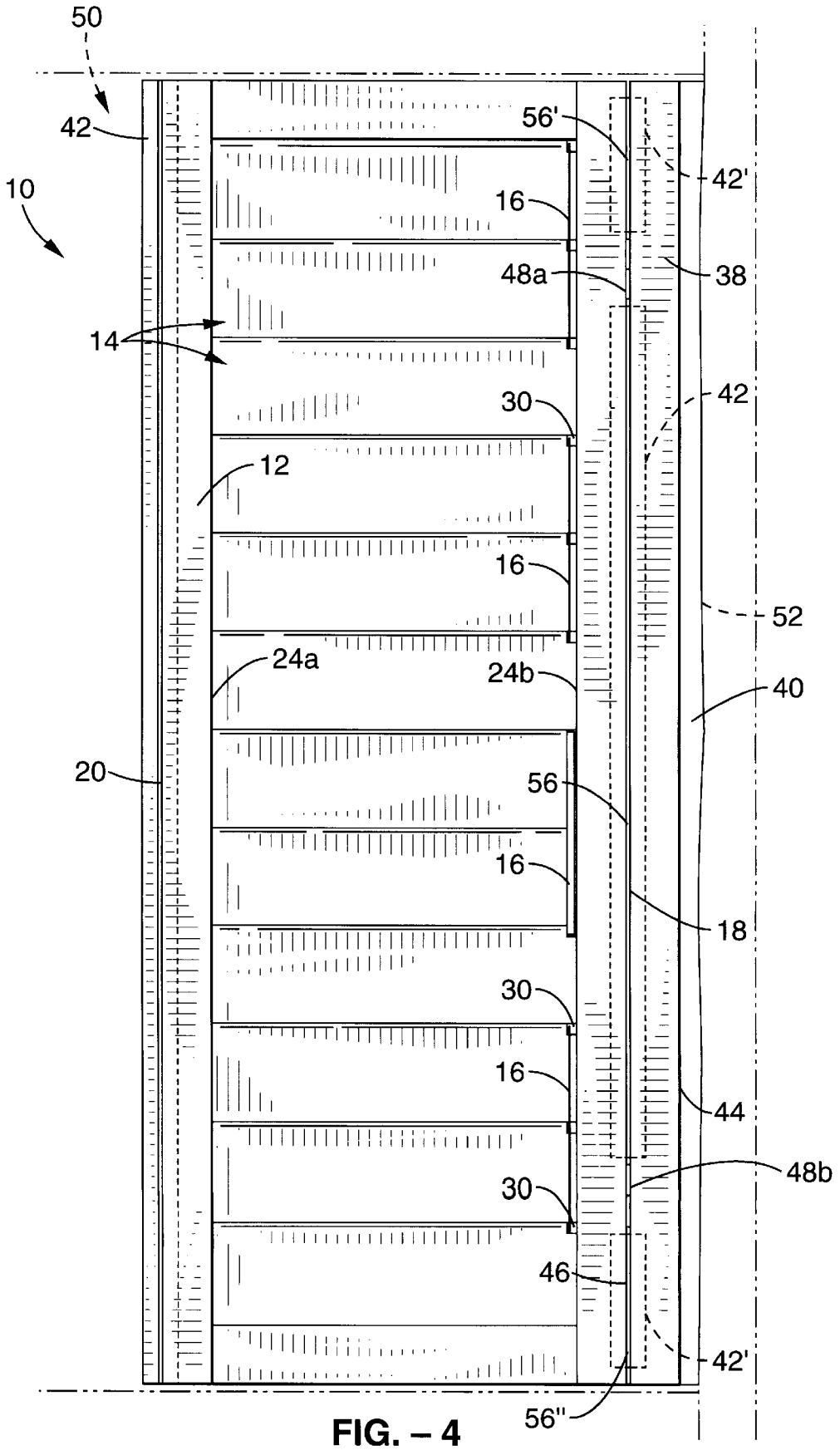
FIG. 4 is a frontal view of the apparatus shown in FIG. 1, mounted within a window opening shown in phantom.

Apparatus 10 further comprises a hanging strip 38, a compliance strip 40, and concealment strips 42 and 42'. Hanging strip 38 includes an inner edge 44, an outer edge 46 and a hinge means 48*a* and 48*b* for pivotally attaching frame member 12 thereto. Hanging strip 38 is juxtaposed frame member 12, wherein inner side edge 18 of frame member 12 is adjacent outer edge 46 of hanging strip 38. Hinge means 48*a* and 48*b* allow for movement of frame member 12 between a closed position, as shown in FIG. 4, and an open position (not shown).

In addition to hingeably receiving frame member 12, hanging strip 38 also serves the purpose of adapting and fitting apparatus 10 within a window opening 50. To accomplish this, hanging strip 38 is inserted within window opening 50 whereby outer edge 46 of hanging strip 38 is placed adjacent the lateral surface 52 of window opening 50. Those skilled in the art will attest that although lateral surface 52 of window opening 50 is perpendicular to level ground, lateral surface 52 of window opening 50 is often not perfectly linear and consists of slight dimensional variations, as shown in FIG. 4. As a result of the aforementioned dimensional variations, crevices exist between inner edge 44 of hanging strip 34 and lateral surface 52 of window opening 50. Said crevices are obviously undesirable as they may reduce privacy and protection from atmospheric elements for the occupants within the room enclosed thereby.

Compliance strip 40 is employed as a means for adjusting for dimensional variations that exist along lateral surface 52 of window opening 50. Compliance strip 40 is composed of a compressible material that is affixed onto inner edge 44 of hanging strip 38 and extends along the entire length thereof.

Compliance strip 40 is preferably fabricated of plastic, although other materials possessing like compressible characteristics may be employed. Compliance strip 40 is affixed to hanging strip 38 preferably by a plurality of screws 54, although those skilled in the art will appreciate that other like means of affixing compliance strip 40 onto hanging strip 38 may also be used, such as but not limited to, nails, glue, rivets, adhesive tape, or hook and loop fastener. Screws 54 may be tightened as required to match the dimensional variations along lateral surface 52 of window opening 50, thereby elimination any crevices that may otherwise exist when hanging strip 38 is mounted therein.

In practical applications, apparatus 10 is generally installed in pairs wherein each functions as a mirror image of the other. As such, outer side edges 20 of frame members 12 reside adjacent one another when both frame members 18 are in the closed position. In this closed position, a first gap 56 exists between hanging strip 38 and frame member 12 and a second gap (not shown) exists between the pair of frame members 18. As is the case with crevices, gaps also reduce privacy and protection from atmospheric elements. Concealment strip 42 is disposed between hanging strip 38 and frame member 12 as a means for concealing first gap 56. Shorter sections 42' of 42 may be inserted in first gap 56' above hinge means 44*a* and also in first gap 56" below hinge means 44*b*. Similarly, concealment strip 42 is also disposed between the pair of frame members 18 as a means for concealing the second gap that may exist when both frame members 18 are in the closed position. Concealment strip 42 and 42' are preferably flexible and has a T-shaped cross-section whereby the center edge of the "T" is inserted into first gaps 52, 52' and 52" as well as the second gap. Concealment strips 42 and 42' are held in place by any known or available means, such as but not limited to, surface compression, glue, screws, nails, or rivets. Concealment strips 42 and 42' may be inserted between first gaps 52, 52' and 52" and the second gap from either the inner plane 34 or outer plane 36 of frame member 12.

Although the description above contains many specificities, these should not be construed as limiting the scope of the invention but as merely providing illustrations of some of the presently preferred embodiments of this invention. Thus, the scope of this invention should be determined by the appended claims and their legal equivalents.

What is claimed is:

1. An adjustable window shutter apparatus, comprising:

(a) a frame member, said frame member including an inner side edge, an outer side edge, and an opening disposed therebetween;

(b) a plurality of louvers disposed within said opening of said frame member, each said louver includes a lateral edge thereon, wherein said louvers are pivotable between a closed position and an open position;

(c) a relief notch on said lateral edge of each said louver; and (d) a louver adjusting member pivotally attached to said plurality of louvers, said louver adjusting member disposed within said relief notch of said louvers.

2. A apparatus as recited in claim 1, further comprising a hanging strip, said hanging strip including an inner edge, an outer edge, and means for pivotally attaching said frame member to said hanging strip, wherein said inner edge of said hanging strip is adjacent said outer side edge of said frame member, and wherein said frame member is movable between a closed position and an open position.

3. An apparatus as recited in claim 2, further comprising a means for adjusting for dimensional variations existing on a side surface of a window opening when said hanging strip is positioned adjacent thereto.

4. An apparatus as recited in claim 3, wherein said means for adjusting for dimensional variations comprises a compliance strip attached to said outer edge of said hanging strip.

5. An apparatus as recited in claim 2, further comprising a concealment strip disposed between said hanging strip and said frame member.

6. An apparatus as recited in claim 1, further comprising a concealment strip attached to said inner side edge of said frame member.

7. An apparatus as recited in claim 1, wherein said frame member includes an inner plane and an outer plane, and wherein said louver adjusting member resides between said inner plane and said outer plane of said frame member when said louvers are in said closed position.

8. An apparatus as recited in claim 1, further comprising a plurality of louver adjusting members, wherein each said louver adjusting member is attached to a plurality of louvers in consecutive fashion, thereby providing for independent adjustability for each said louver adjusting member.

9. An adjustable window shutter apparatus, comprising:

(a) a frame member, said frame member including an inner side edge, an outer side edge, and an opening disposed therebetween;

(b) a plurality of louvers disposed within said opening of said frame member, each said louver includes a lateral edge thereon, wherein said louvers are pivotable between a closed position and an open position;

(c) a relief notch on said lateral edge of each said louver; and (d) a louver adjusting member pivotally attached to said plurality of louvers, said louver adjusting member disposed within said relief notch of said louvers;

(e) a hanging strip that includes an inner edge, an outer edge, and means for pivotally attaching said frame member to said hanging strip, wherein said inner edge of said hanging strip is adjacent said outer side edge of said frame member, and wherein said frame member is movable between a closed position and an open position; and (f) means for adjusting for dimensional variations existing on a side surface of a window opening when said hanging strip is positioned adjacent thereto.

10. An apparatus as recited in claim 9, wherein said means for adjusting for dimensional variations comprises a compliance strip attached to said outer edge of said hanging strip.

11. An apparatus as recited in claim 9, further comprising a concealment strip disposed between said hanging strip and said frame member.

12. An apparatus as recited in claim 9, further comprising a concealment strip attached to said inner side edge of said frame member.

13. An apparatus as recited in claim 9, wherein said frame member includes an inner plane and an outer plane, and wherein said louver adjusting member resides between said inner plane and said outer plane of said frame member when said louvers are in said closed position.

14. An apparatus as recited in claim 9, further comprising a plurality of louver adjusting members, wherein each said louver adjusting member is attached to a plurality of louvers in consecutive fashion, thereby providing for independent adjustability for each said louver adjusting member.

15. An adjustable window shutter apparatus, comprising:

(a) a frame member, said frame member including an inner side edge, an outer side edge, and an opening disposed there between;

(b) a plurality of louvers disposed within said opening of said frame member, each said louver includes a lateral edge thereon, wherein said louvers are pivotable between a closed position and an open position; and (c) a plurality of louver adjusting members, wherein each said louver adjusting member is pivotally attached to a plurality of louvers in consecutive fashion, thereby providing for independent adjustability for each said louver adjusting member and;

(d) a relief notch disposed said lateral edge of each said louver, wherein said louver adjusting members are disposed within said respective notches.

16. A apparatus as recited in claim 15, further comprising a hanging strip, said hanging strip including an inner edge, an outer edge, and means for pivotally attaching said frame member to said hanging strip, wherein said inner edge of said hanging strip is adjacent said outer side edge of said frame member, and wherein said frame member is movable between a closed position and an open position.

17. An apparatus as recited in claim 16, further comprising a means for adjusting for dimensional variations existing on a side surface of a window opening when said hanging strip is positioned adjacent thereto.

18. An apparatus as recited in claim 17, wherein said means for adjusting for dimensional variations comprises a compliance strip attached to said outer edge of said hanging strip.

19. An apparatus as recited in claim 18, further comprising a concealment strip disposed between said hanging strip and said frame member.

20. An apparatus as recited in claim 17, further comprising a concealment strip attached to said inner side edge of said frame member.

21. An apparatus as recited in claim 15 wherein said frame member includes an inner plane and an outer plane, and wherein said louver adjusting member resides between said inner plane and said outer plane of said frame member when said louvers are in said closed position.

* * * * *